US008015999B2

(12) United States Patent
Teng et al.

(10) Patent No.: US 8,015,999 B2
(45) Date of Patent: Sep. 13, 2011

(54) WEAVING MACHINES AND THREE-DIMENSIONAL WOVEN FABRICS

(75) Inventors: Yung-Shun Teng, Taipei (TW); Li-Yun Chang, Taipei County (TW); Fen-Lan Tseng, Taipei County (TW); Yang-Ping Shih, Taipei County (TW)

(73) Assignee: Taiwan Textile Research Institute, New Taipei (TW)

( * ) Notice: Subject to any disclaimer, the term of this patent is extended or adjusted under 35 U.S.C. 154(b) by 0 days.

(21) Appl. No.: 12/642,353

(22) Filed: Dec. 18, 2009

(65) Prior Publication Data

US 2011/0132488 A1 Jun. 9, 2011

(30) Foreign Application Priority Data

Dec. 4, 2009 (TW) ..... 98141578 A

(51) Int. Cl.
*D03D 41/00* (2006.01)
*D03D 49/00* (2006.01)
*D03D 47/34* (2006.01)

(52) U.S. Cl. ..... 139/11; 139/25; 139/26

(58) Field of Classification Search ..... 139/25, 139/26

See application file for complete search history.

(56) References Cited

U.S. PATENT DOCUMENTS 2,515,389 A * 7/1950 Campbell et al. ..... 139/115
3,101,747 A * 8/1963 Hindle ..... 139/109
3,302,665 A * 2/1967 McHargue ..... 139/25
3,498,337 A * 3/1970 Hindle ..... 139/110
3,526,252 A * 9/1970 Hindle et al. ..... 139/110
3,626,989 A * 12/1971 Held ..... 139/121
3,753,451 A * 8/1973 Hosono et al. ..... 139/110
3,810,493 A * 5/1974 Mizuno ..... 139/110
4,503,113 A * 3/1985 Smart ..... 442/199
5,044,408 A * 9/1991 Vandeweghe et al. ..... 139/115
5,259,420 A * 11/1993 Foster ..... 139/97
5,261,465 A * 11/1993 Dore ..... 139/103
5,921,111 A * 7/1999 Maier et al. ..... 66/87
5,947,164 A * 9/1999 Norlin ..... 139/308
6,135,162 A * 10/2000 Dornier et al. ..... 139/110
6,135,163 A * 10/2000 Wahhoud et al. ..... 139/114
6,592,069 B1 * 7/2003 Cobble ..... 242/598
6,918,410 B1 * 7/2005 Berger ..... 139/21
2006/0219313 A1 * 10/2006 Gstrein et al. ..... 139/383 A
2008/0156043 A1 * 7/2008 Gustin ..... 66/4
2009/0253326 A1 * 10/2009 Gstrein et al. ..... 442/326

* cited by examiner

*Primary Examiner* — Bobby Muromoto, Jr.
(74) *Attorney, Agent, or Firm* — J.C. Patents

(57) ABSTRACT

A weaving machine for weaving a three-dimensional distance woven fabric including two outer fabrics and inter-yarns connected with the outer fabrics is provided. The weaving machine includes a warp let-off mechanism, heald frames, a picking mechanism, a beating-up mechanism, a yarn raising mechanism, and a take-up mechanism. The warp let-off mechanism includes at least two warp beams for providing and transferring warps. A plurality of vertically arranged heald wires are supported by each of the heald frames, wherein each of the heald wires has a heald eye for the warps passing through. The warps are driven and divided into two warp layers by the heald frames such that a shed is formed between the two warp layers. The picking mechanism transfers wefts to pass through the shed. The yarn raising mechanism is suitable for passing through the shed and raising parts of the warps functioning as the inter-yarns.

6 Claims, 6 Drawing Sheets

WEAVING MACHINES AND THREE-DIMENSIONAL WOVEN FABRICS

CROSS-REFERENCE TO RELATED APPLICATION

This application claims the priority benefit of Taiwan application serial no. 98141578, filed on Dec. 4, 2009. The entirety of the above-mentioned patent application is hereby incorporated by reference herein and made a part of specification.

BACKGROUND OF THE INVENTION

1. Field of the Invention

The present invention relates to a weaving machine. More particularly, the present invention relates to a weaving machine for fabricating three-dimensional woven fabrics.

2. Description of Related Art

Under the trend of globalization, the fabrics industry is facing severe competition, and fabric manufacturers have to continue researching and developing new technology and diversified products to keep up with the competition worldwide. Recently, not only fantastic exterior design of the textiles or fabrics is required, but also comfortable and protective fabrics are required. Accordingly, fabrics with multiple functionalities have become mainstream products.

Several methods for fabricating three-dimensional distance fabrics have been proposed by prior arts. For example, three-dimensional distance fabrics are often applied to fabrics for victim relieving, ships, protection buffer fabrics, flooring, and so on. The gap between two outer fabrics of the distance fabric is usually required to be greater than 1 centimeter. In addition, the gap between two outer fabrics of the three-dimensional distance fabrics is modified according to different applications. Nowadays, three-dimensional distance fabrics with superior gap are often fabricated by velvet weaving machines. The gap of the distance fabrics fabricated by velvet weaving machines is about 20 centimeters at most. Obviously, distance fabrics with a gap greater than 20 centimeters cannot be fabricated by velvet weaving machines. Accordingly, how to fabricate three-dimensional distance fabrics with a gap greater than 20 centimeters to meet different design requirements is an important issue to be solved.

SUMMARY OF THE INVENTION

The present application provides a weaving machine for fabricating three-dimensional woven fabrics having superior gap without significantly increasing costs.

The present application further provides a three-dimensional woven fabric having superior gap greater than 20 centimeters.

The application provides a weaving machine for weaving a three-dimensional woven fabric including two outer fabrics and a plurality of inter-yarns connected with the outer fabrics. The weaving machine includes a warp let-off mechanism, a plurality of heald frames, a picking mechanism, a beating-up mechanism, a yarn raising mechanism, and a take-up mechanism. The warp let-off mechanism includes at least two warp beams for providing and transferring a plurality of warps. A plurality of vertically arranged heald wires are supported by each of the heald frames, wherein each of the heald wires has a heald eye for the warps passing through. The warps are driven from two warp beams, and divided into two layers by the heald frames such that a shed is formed between them. The picking mechanism transfers wefts to pass through the shed between the warp layers. The beating-up mechanism is suitable for pushing the wefts such that the wefts and the warps are interwoven to form the outer fabrics, wherein the heald frames are located between the warp let-off mechanism and the beating-up mechanism. The yarn raising mechanism is suitable for passing through the shed and raising parts of the warps functioning as the inter-yarns. The take-up mechanism is suitable for adjusting and controlling latitude density of the three-dimensional woven fabric.

In an embodiment of the present application, the warp let-off mechanism has at least two back rests corresponding to the warp beams.

In an embodiment of the present application, the back rests include a first back rest and a second back rest. Parts of the warps functioning as the inter-yarns are provided by the first back rest, and other parts of the warps are provided by the second back rest. The first back rest is a movable active back rest.

In an embodiment of the present application, the movable active back rest moves towards the heald frames when the parts of the warps functioning as the inter-yarns are pulled by the yarn raising mechanism.

In an embodiment of the present application, the yarn raising mechanism moves to the top of the shed such that the parts of the warps functioning as the inter-yarns are pulled upwardly.

In an embodiment of the present application, the beating-up mechanism is located between the heald frames and the take-up mechanism. In addition, the yarn raising mechanism in the shed is suitable for moving towards the take-up mechanism such that the parts of the warps functioning as the inter-yarns are pulled laterally.

The application further provides a three-dimensional distance woven fabric including two outer fabrics and a plurality of inter-yarns connected with the outer fabrics, wherein a gap between the outer fabrics of the three-dimensional distance woven fabric is greater than 20 centimeters.

In an embodiment of the present application, the distance between the outer fabrics is greater than 50 centimeters.

In an embodiment of the present application, the distance between the outer fabrics is greater than 100 centimeters.

In an embodiment of the present application, the distance between the outer fabrics is greater than 200 centimeters.

In order to make the aforementioned and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 1' schematically illustrates that the yarn raising mechanism extends into the shed and pulls parts of the warps.

DESCRIPTION OF EMBODIMENTS

Figure 1:
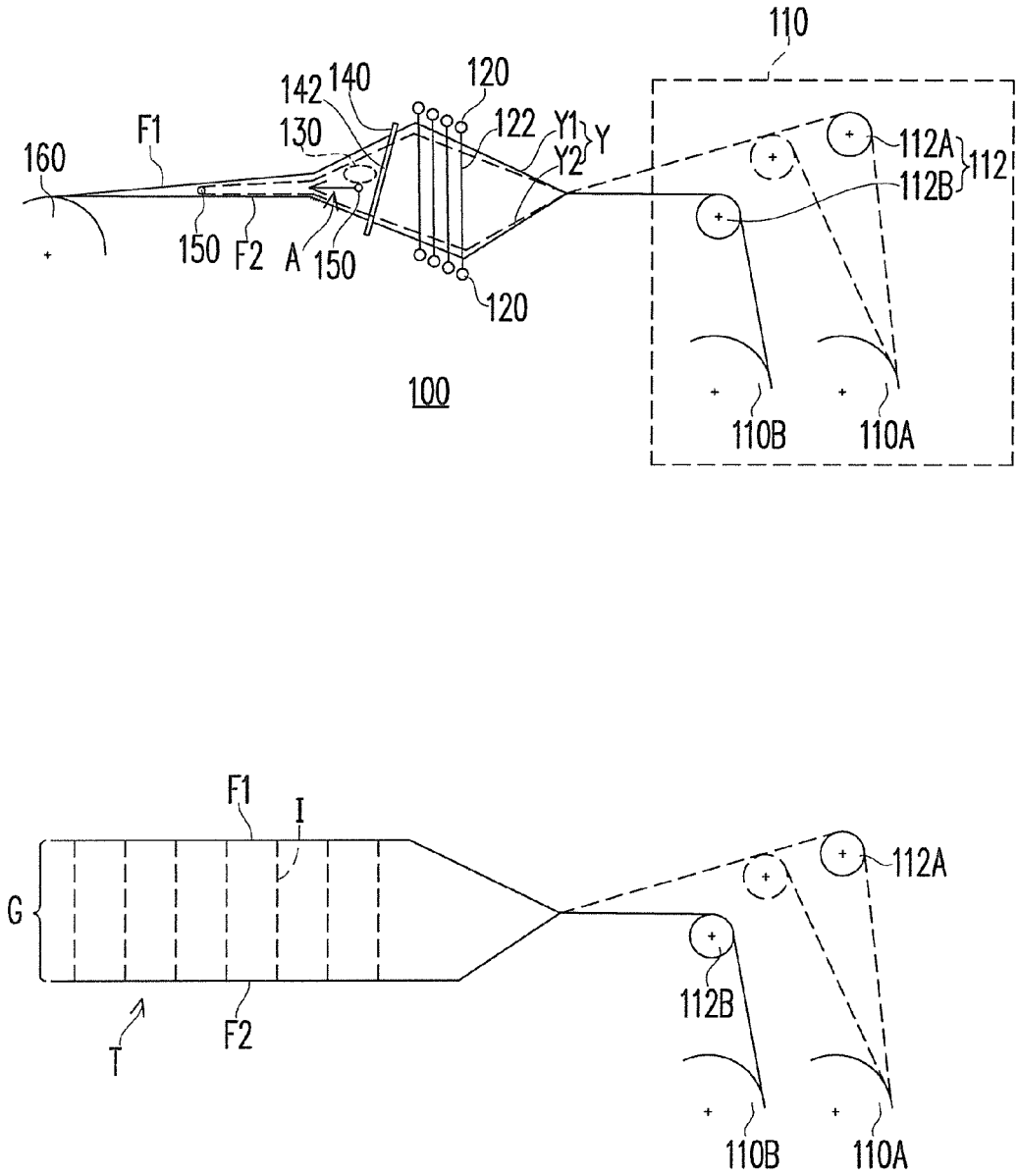
FIG. 1 is a schematic side view of a weaving machine according to an embodiment of the present application.
Figure 1:
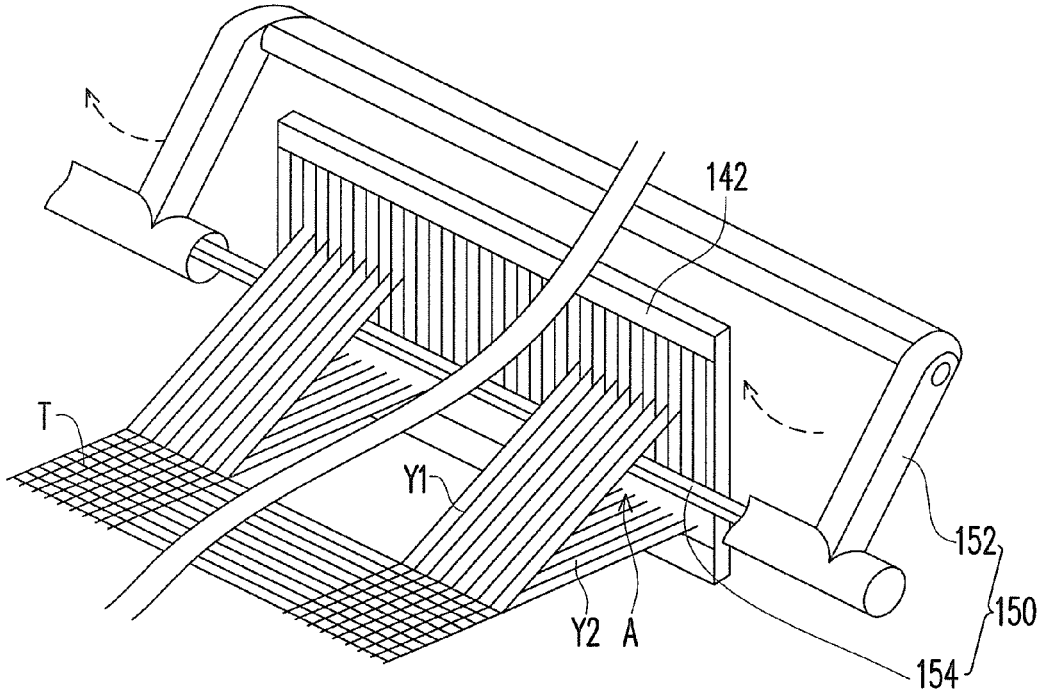

FIG. 1 is a schematic side view of a weaving machine according to an embodiment of the present application.

Referring to FIG. 1, in this embodiment, the weaving machine 100 for weaving a three-dimensional distance woven fabric T includes two outer fabrics F1, F2 and a plurality of inter-yarns I connected with the outer fabrics F1, F2. As shown in FIG. 1, the weaving machine 100 includes a warp let-off mechanism 110, a plurality of heald frames 120, a picking mechanism 130, a beating-up mechanism 140, a yarn raising mechanism 150, and a take-up mechanism 160. The warp let-off mechanism 110 includes at least two warp beams 110A, 110B for providing and transferring a plurality of warps Y. A plurality of vertically arranged heald wires 122 are supported by each of the heald frames 120, wherein each of the heald wires 122 has a heald eye (not shown) for the warps Y passing through. The warps Y are driven from two warp beams, and divided into two warp layers Y1, Y2 by the heald frames 120 such that a shed A is formed between the two warp layers Y1, Y2. The picking mechanism 130 transfers weft to pass through the shed A between the warp layers Y1, Y2. The beating-up mechanism 140 (e.g. a reed 142) is suitable for pushing the wefts such that the wefts and the warps Y are interwoven to form the outer fabrics F1, F2. The heald frames 120 are located between the warp let-off mechanism 110 and the beating-up mechanism 140. The yarn raising mechanism 150 is suitable for passing through the shed A and raising parts of the warps Y functioning as inter-yarns I. The take-up mechanism 160 is suitable for adjusting and controlling latitude density of the three-dimensional distance woven fabric T. In addition, the beating-up mechanism 140 is located between the heald frames 120 and the take-up mechanism 160.

In this embodiment, the warp let-off mechanism 110 has at least two back rests 112 corresponding to the warp beams 110A, 110B. Specifically, parts of the warps Y functioning as the inter-yarns I are provided by the first back rest 110A, and the other parts of the warps Y are provided by the second back rest 110B. Here, the warps Y provided from the second back rest 110B are used to fabricate the outer fabrics F1, F2.

In order to simultaneously move with the yarn raising mechanism 150, the first back rest 112A may be a movable active back rest. The first back rest 112A (i.e. the movable active back rest) moves towards the heald frames 120 simultaneously when the parts of the warps Y functioning as the inter-yarns I are pulled by the yarn raising mechanism 150. It is noted that the first back rest 112A may includes at least one movable roller while the second back rest 112B may includes at least one roller. The warps Y are transferred through rotation of the above-mentioned rollers.

In this embodiment, the gap G between the outer fabrics F1, F2 of the three-dimensional distance woven fabric T can be well adjusted through control of the length of the inter-yarns I. Specifically, the pulling range of the yarn raising mechanism 150 is relevant to the length of the inter-yarns I. In this embodiment, the pulling range of the yarn raising mechanism 150 ranges from about 10 centimeters to about 100 centimeters. Certainly, the pulling range of the yarn raising mechanism 150 can be properly modified to meet design requirements of other products. It is noted that the pulling direction is properly selected to avoid the moving of the yarn raising mechanism 150 from being obstructed when the inter-yarns I are pulled. Accordingly, by properly selecting the pulling range of the yarn raising mechanism 150, the three-dimensional distance woven fabric T having superior gap G can be integrally-woven.

The three-dimensional distance woven fabric T includes two outer fabrics F1, F2 and a plurality of inter-yarns I connected with the outer fabrics F1, F2, wherein a gap G distance between the outer fabrics F1, F2 of the three-dimensional distance woven fabric T is greater than 20 centimeters. In an embodiment of the present application, the gap G between the outer fabrics F1, F2 is greater than 50 centimeters, for example. In an alternative embodiment of the present application, the gap G distance between the outer fabrics F1, F2 is greater than 100 centimeters or 200 centimeters, for example. It is noted that pulling distance range of the yarn raising mechanism 150 is approximately a half one of the gap G.

In an alternative embodiment of the present application, the yarn raising mechanism 150 moves to the top of the shed A such that the parts of the warps Y functioning as the inter-yarns I can be pulled upwardly, as shown in FIG. 2A to FIG. 2D. However, the pulling direction and the distance range of the yarn raising mechanism 150 are not limited in the present application. For example, the yarn raising mechanism 150 in the shed A can also move towards the take-up mechanism 160 such that the parts of the warps Y functioning as the inter-yarns I are pulled laterally, as shown in FIG. 3A to FIG. 3D.

FIG. 1' schematically illustrates that the yarn raising mechanism extends into the shed and pulls parts of the warps. Referring to FIG. 1', the yarn raising mechanism 150 of this embodiment includes a driving unit 152 and a pulling unit 154 connected with the driving unit 152. Specifically, the pulling unit 154 is suitable for extending into the shed A between the warp layers Y1, Y2. In addition, the pulling unit 154 is driven by the driving unit 152 to move to the top of the shed A or to move towards the take-up mechanism 160. The design of the yarn raising mechanism 150 is limited to the mechanism illustrated in FIG. 1', other mechanical designs may be used in the present application.

Figure 2A:
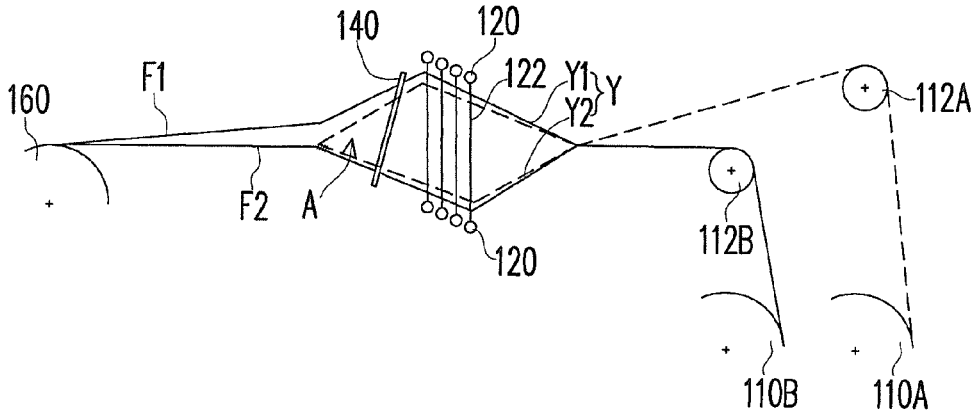
FIG. 2A to FIG. 2D are schematic views illustrating a weaving process according to the first embodiment of the present application.

FIG. 2A to FIG. 2D are schematic views illustrating a weaving process according to the first embodiment of the present application. Referring to FIG. 2A, first, general weaving process including warp let-off procedure, shed forming procedure, wefts-picking procedure, beating-up procedure and take-up procedure are performed continuously such that the outer fabrics F1, F2 are woven.

Figure 2B:
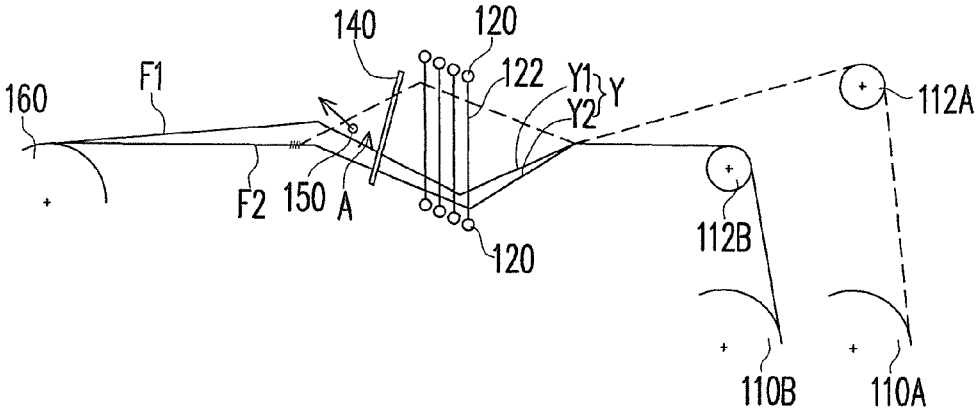
Figure 2C:
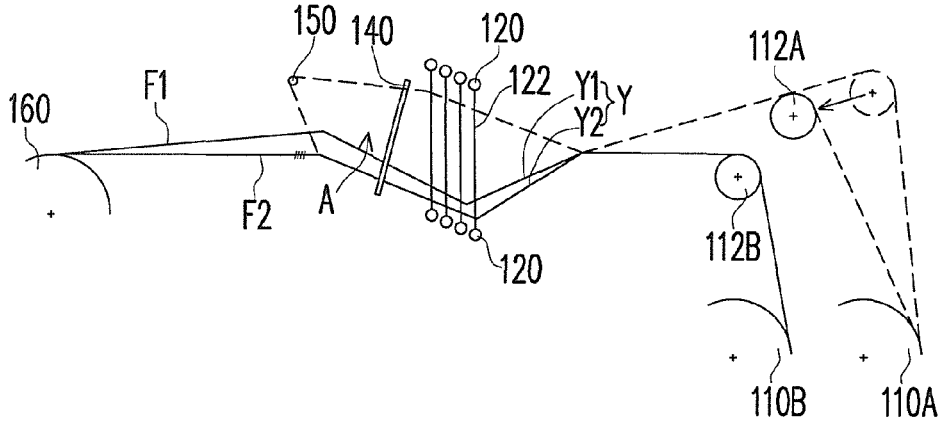

Referring to FIG. 2B and FIG. 2C, the warps Y provided from the warp beam 110B are arranged at the bottom of the shed A and the warps Y provided from the warp beam 110A are arranged at the top of the shed A. At this time, the yarn raising mechanism 150 extends into the shed A from two ends of the shed A and moves upwardly to the top of the shed A. Accordingly, the warps Y arranged at the top of the shed A are pulled upwardly. In this embodiment, the pulling range of the yarn raising mechanism 150 can be properly evaluated and adjusted according to the required gap of the three-dimensional woven fabrics. After the warps Y are pulled upwardly, the yarn raising mechanism 150 is ejected from two ends of the shed A. Meanwhile, the inter-yarns I having a predetermined length are located naturally over the outer fabric F1.

Figure 2D:
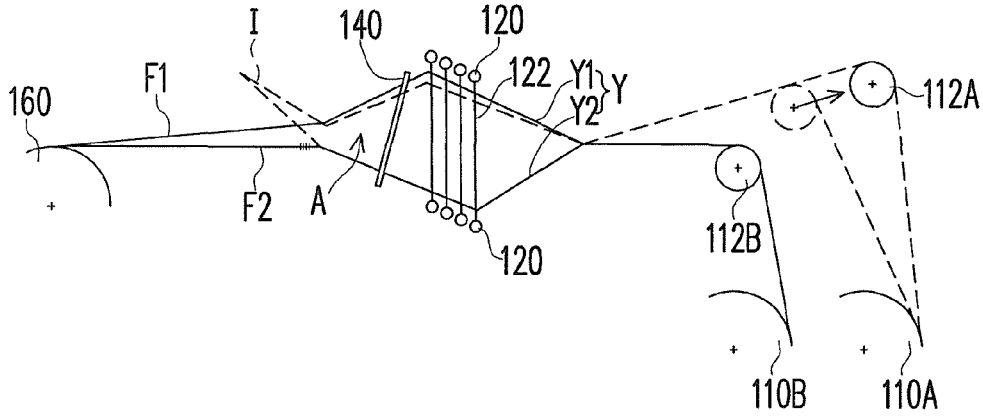
Figure 3A:
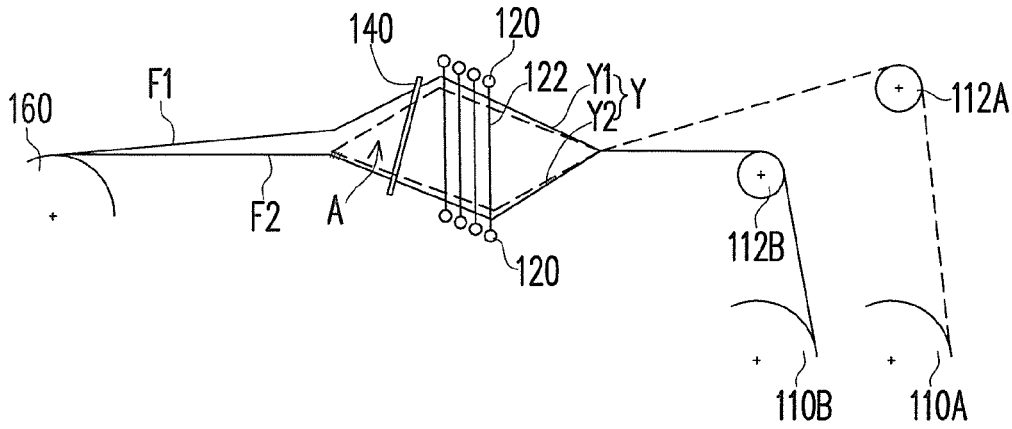
FIG. 3A to FIG. 3D are schematic views illustrating a weaving process according to the second embodiment of the present application.
Figure 3B:
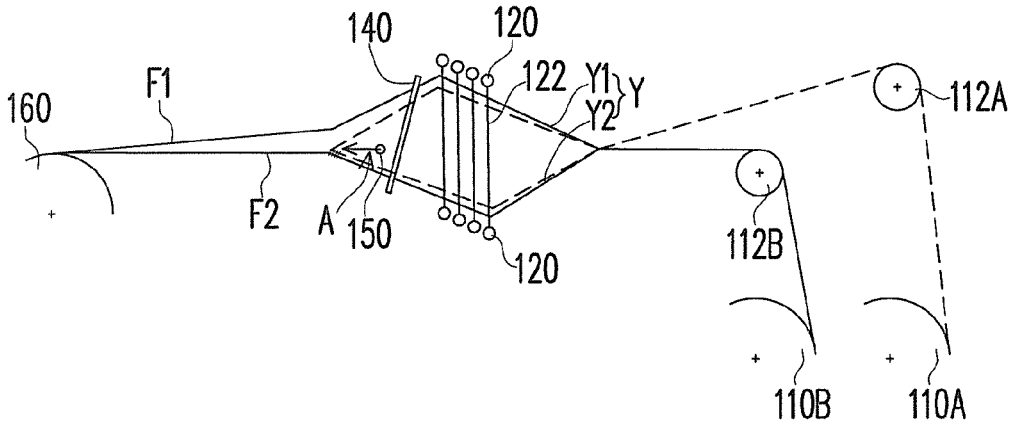
Figure 3C:
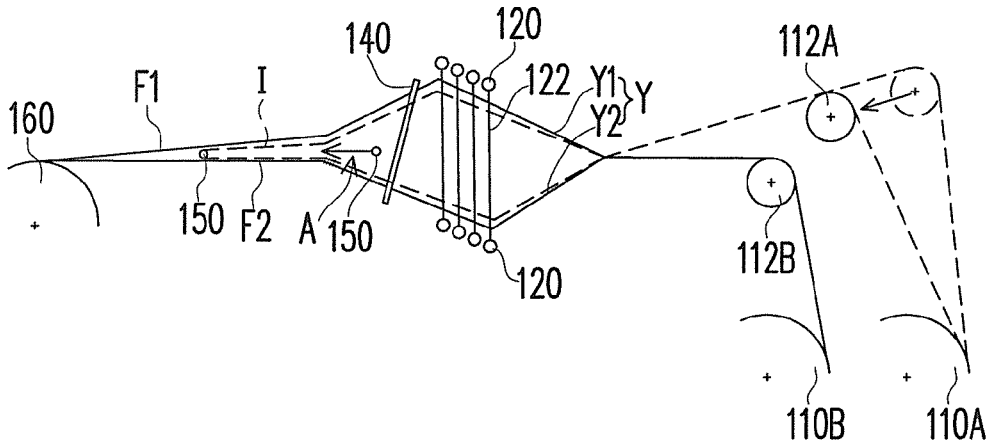
Figure 3D:
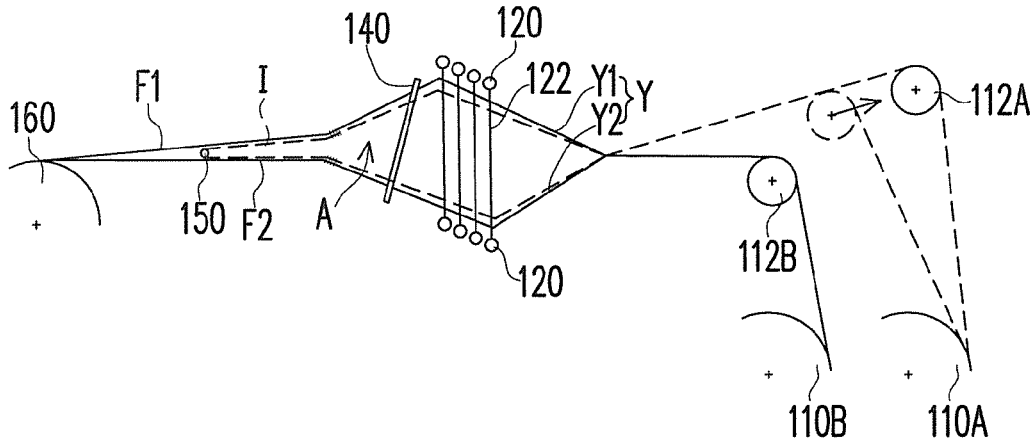

Referring to FIG. 2D, after the warps Y are pulled upwardly, general weaving process including warp let-off procedure, shed forming procedure, picking procedure, beating-up procedure and take-up procedure are performed continuously. It is noted that the number or the frequency of the warps Y being pulled can be properly modified according to actual design requirements.

FIG. 3A to FIG. 3D are schematic views illustrating a weaving process according to the second embodiment of the present application. Referring to FIG. 3A through FIG. 3D, the weaving process of this embodiment is similar with that illustrated in the FIG. 2A through FIG. 2D except that the yarn raising mechanism 150 extends into the shed A from two ends of the shed A and moves towards the take-up mechanism 160 such that the parts of the warps Y functioning as the inter-yarns I are pulled laterally.

The present application provides a weaving machine for fabricating three-dimensional woven fabrics having superior gap without significantly increasing costs. In addition, the three-dimensional distance woven fabrics of the present application may easily have a gap greater than 20 centimeters.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A weaving machine for weaving a three-dimensional distance woven fabric including two outer fabrics and a plurality of inter-yarns connected with the outer fabrics, comprising:

a warp let-off mechanism including at least two warp beams for providing and transferring a plurality of warps;

a plurality of vertically arranged heald wires, supported by each of the heald frames, each of the heald wires having a heald eye for the warps passing through, the warps being driven and divided into two warp layers by the heald frames, and a shed being formed between the two warp layers;

a picking mechanism transferring wefts to pass through the shed along a transferring direction;

a beating-up mechanism pushing the wefts, the wefts and the warps being interwoven to form the outer fabrics, and the heald frames being located between the warp let-off mechanism and the beating-up mechanism;

a yarn raising mechanism passing through the shed along a direction substantially parallel to the transferring direction and raising parts of the warps functioning as the inter-yarns, wherein the yarn raising mechanism is separate from the heald frame; and a take-up mechanism capable of adjusting and controlling latitude density of the three-dimensional distance woven fabric.

2. The weaving machine of claim 1, wherein the warp let-off mechanism has at least two back rests corresponding to the warp beams.

3. The weaving machine of claim 1, wherein the back rests comprises:

a first back rest; and a second back rest, wherein parts of the warps functioning as the inter-yarns are provided by the first back rest, the other parts of the warps are provided by the second back rest, and the first back rest is a movable active back rest.

4. The weaving machine of claim 3, wherein the movable active back rest moves towards the heald frames when the parts of the warps functioning as the inter-yarns are pulled by the yarn raising mechanism.

5. The weaving machine of claim 1, wherein the yarn raising mechanism moves to the top of the shed such that the parts of the warps functioning as the inter-yarns are pulled upwardly.

6. The weaving machine of claim 1, wherein the yarn raising mechanism in the shed is suitable capable of moving towards the take-up mechanism such that the parts of the warps functioning as the inter-yarns are pulled laterally.

* * * * *